US005580662A

United States Patent [19]

Tong et al.

[11] Patent Number: 5,580,662

[45] Date of Patent: Dec. 3, 1996

[54] ANTISTATIC COATING FOR VIDEO DISPLAY SCREEN

[75] Inventors: Hua-Sou Tong, Arlington Heights, Ill.; Chung-Min Hu; Yu-Chung Yu, both of Taiwan, China

[73] Assignee: Chunghwa Picture Tubes, Ltd., Yangmei/Taoyuan, Taiwan

[21] Appl. No.: 400,926

[22] Filed: Mar. 9, 1995

[51] Int. Cl.[6] ..... H01J 29/88

[52] U.S. Cl. ..... 428/432; 428/323; 428/325; 428/328; 428/688; 428/689; 428/702; 428/704; 428/426; 252/500; 252/518; 313/478; 313/479

[58] Field of Search ..... 428/432, 688, 428/689, 702, 704, 426, 323, 325, 328; 252/500, 518; 313/478, 479; 427/126.1, 126.2, 126.3, 164, 165

[56] References Cited

U.S. PATENT DOCUMENTS

| | | | |
|---|---|---|---|
| 2,522,531 | 9/1950 | Mochel | 117/54 |
| 2,564,677 | 8/1951 | Davis | 201/73 |
| 2,564,707 | 8/1951 | Mochel | 117/54 |
| 2,564,709 | 8/1951 | Mochel | 201/73 |
| 2,564,710 | 8/1951 | Mochel | 201/73 |
| 2,808,351 | 10/1952 | Colbert et al. | 117/211 |
| 2,833,902 | 10/1953 | Gaiser et al. | 201/73 |
| 2,852,415 | 9/1958 | Colbert et al. | 117/211 |
| 2,919,212 | 12/1959 | Gaiser | 117/215 |
| 3,093,598 | 6/1963 | McMillan et al. | 252/521 |
| 3,252,829 | 5/1966 | Romstadt et al. | 117/211 |
| 4,263,335 | 4/1981 | Wagner et al. | 427/29 |
| 4,393,095 | 7/1983 | Greenberg | 427/87 |
| 4,468,702 | 8/1984 | Jandrell | 358/245 |
| 4,490,227 | 12/1984 | Bitter | 204/192 SP |
| 4,563,612 | 1/1986 | Deal et al. | 313/478 |
| 4,649,126 | 3/1987 | Gaprindashvili et al. | 501/43 |
| 4,650,557 | 3/1987 | Bitter | 204/192.12 |
| 4,785,217 | 11/1988 | Matsuda et al. | 313/479 |
| 4,945,282 | 7/1990 | Kawamura et al. | 313/479 |
| 4,987,338 | 1/1991 | Itou et al. | 313/478 |
| 5,099,171 | 3/1992 | Daiku et al. | 313/479 |
| 5,122,709 | 6/1992 | Kawamura et al. | 313/479 |
| 5,189,337 | 2/1993 | Endo et al. | 313/479 |
| 5,204,177 | 4/1993 | Sato | 428/328 |
| 5,241,097 | 8/1993 | Zupancic et al. | 556/460 |
| 5,254,904 | 10/1993 | Van De Leest et al. | 313/479 |
| 5,279,851 | 1/1994 | Minosou et al. | 427/126.2 |
| 5,291,097 | 3/1994 | Kawamura et al. | 313/478 |
| 5,376,308 | 12/1994 | Hirai | 252/518 |
| 5,382,383 | 1/1995 | Hirai | 252/501.1 |
| 5,404,073 | 4/1995 | Tong | 313/479 |

FOREIGN PATENT DOCUMENTS 0585819 8/1993 European Pat. Off. .

OTHER PUBLICATIONS

The Merck Index, Merck and Co., Inc., 1983, p. 475 and 550.

*Primary Examiner*—Archene Turner
*Attorney, Agent, or Firm*—Emrich & Dithmar

[57] ABSTRACT

An antistatic coating for the outer surface of a video display panel such as of a cathode ray tube (CRT), and a method of applying this type of surface coating, employs a conventional antistatic material such as antimony doped tin oxide to which is added a solvent which is (1) soluble in water and alcohol, (2) has an evaporation point higher than that of water, and (3) has greater solubility for oil-based contaminants than for water. Solvents having these characteristics and which are adapted for use in the antistatic coating include ethylene glycol and dimethyl-based solvents, and their derivatives. The antistatic coating has reduced susceptibility to picking up surface contaminants such as dust and wiping residues such as applied in cleaning the display panel, particularly during manufacture, while affording a high degree of static charge dissipation.

7 Claims, 1 Drawing Sheet

ANTISTATIC COATING FOR VIDEO DISPLAY SCREEN

FIELD OF THE INVENTION

This invention relates generally to video displays and is particularly directed to an antistatic coating for the outer surface of a video display screen.

BACKGROUND OF THE INVENTION

Cathode ray tubes (CRTs) operate at high voltages causing the glass display screen surface of the CRT to become electrically charged by static induction. This static electricity attracts dust and other contaminants in the air causing them to collect on the display screen's outer surface which degrades the video image presented on the display screen. In addition, when a person touches the CRT's display screen, he or she may experience a slight shock by discharge of the static electricity. In addition to being unpleasant to the touch, this static discharge may disrupt the operation of a computer when the CRT is employed in a computer terminal. Other types of video displays such as liquid crystal displays (LCDs), plasma discharge screens (PDPs), vacuum florescent screens, and gas discharge screens also suffer from the aforementioned problems.

The build-up of static charge on the faceplate of a video display arises because of the dielectric nature of glass. Current antistatic coatings for video display screens typically include semiconductor-type materials such as antimony doped tin oxide which is typically mixed with an organic solvent such as ethanol or isopropanol. Unfortunately, problems are frequently encountered in this coating process during video display manufacture because these antistatic coating materials are very sensitive to surface contamination and wiping residues which remain after the display screen is cleaned. For example, water marks frequently remain after the display screen is cleaned during video display manufacture and assembly. This surface contamination and residual deposits on the display screen reduce the manufacturing yields of the video displays.

The present invention addresses the aforementioned limitations of the prior art by providing an antistatic coating for virtually all types of video display screens which is easily applied in a uniform manner on the display screen, is resistant to atmospheric contamination and water marks, and substantially increases the manufacturing yield of video displays employing the inventive antistatic coating.

OBJECTS AND SUMMARY OF THE INVENTION

Accordingly, it is an object of the present invention to provide an improved antistatic coating for a display screen in a video display apparatus.

It is another object of the present invention to provide an antistatic coating which is highly consistent and predictable in its application to the outer surface of a video display screen and thus increases manufacturing yields of video display devices such as CRTs.

Yet another object of the present invention is to provide an antistatic coating for the display screen of a video display which is easily applied in a uniform manner and is resistant to contaminants particularly of the oil-based type which tend to adhere to the display screen.

A still further object of the present invention is to facilitate the manufacture of CRTs by providing an outer coating for its display screen which is highly resistant to contaminants and more easily cleaned to provide a high yield during production.

These objects of the present invention are achieved and the disadvantages of the prior art are eliminated by a video display apparatus comprising a video display panel having an outer and an inner surface; and an antistatic coating layer disposed on the outer surface of the display screen, the coating layer comprised of antimony doped tin oxide, an organic solvent and either ethylene glycol, or a derivative thereof, or a dimethyl-based solvent, or a derivative thereof, wherein the antistatic coating layer is comprised of 5–20 wt. % of either ethylene glycol or dimethyl-based solvent, or derivatives thereof.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
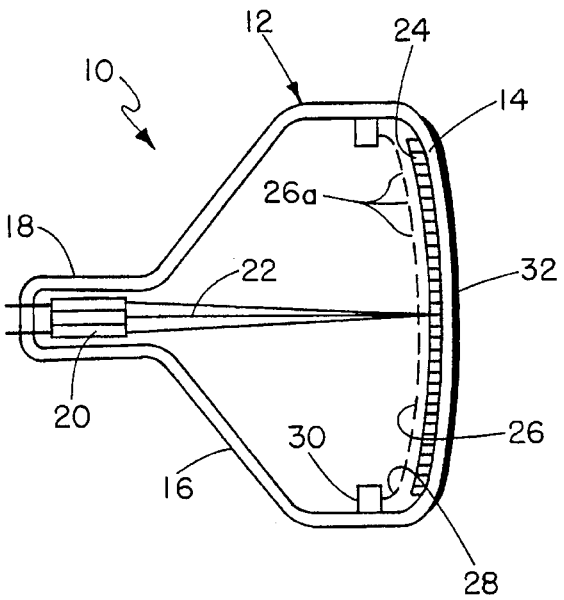
FIG. 1 is a longitudinal sectional view of a CRT incorporating an antistatic coating in accordance with the principles of the present invention.

Referring to FIG. 1, there is shown a sectional view of a color CRT 10 incorporating an antistatic coating 32 in accordance with the principles of the present invention. In the following discussion the terms "display screen" and "display panel" are used interchangeably. CRT 10 includes a sealed glass envelope 12 having a forward faceplate or display screen 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate. Color CRT 10 includes three electron beams 22 directed onto and focused upon the CRT's glass faceplate 14. Disposed in the neck portion 18 of the CRT's glass envelope 12 are a plurality of electron guns 20 typically arranged in an inline array for directing the electron beams 22 onto the phosphor screen 24. The electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures **26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and a mounting spring which also are not shown in the figure for simplicity. The shadow mask mounting fixture 30 may be a attached to the inner surface of the CRT's glass envelope 12 and the shadow mask 26** may be attached to the mounting fixture by conventional means such as weldments or a glass-based frit.

Figure 2:
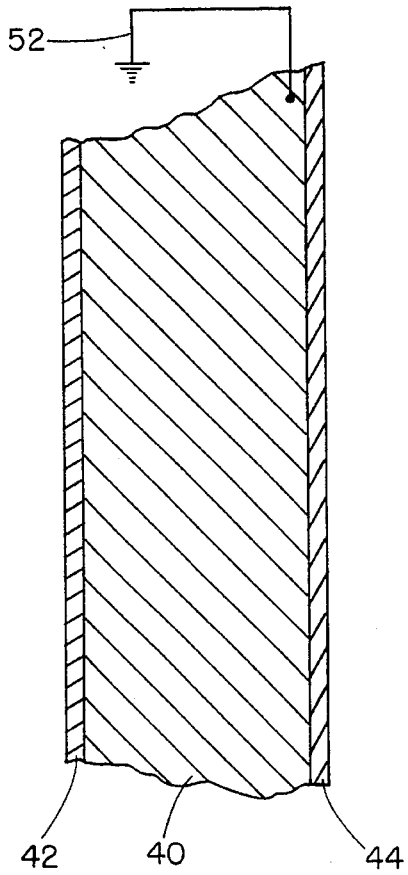
FIG. 2 is a partial sectional view of a flat display screen having an antistatic coating in accordance with the present invention on the outer surface thereof.

Referring to FIG. 2, there is shown a partial sectional view of a portion of a glass display panel, or faceplate, 40 having a phosphor layer 42 on the inner surface thereof and an antistatic coating 44 in accordance with the present invention on the outer surface thereof. The glass display panel 40 is shown in FIG. 2 as being fiat, as the present invention is applicable to both curved and fiat display screens. In addition, while the present invention has been described thus far in terms of use on the outer surface of the display panel of a CRT, the present invention is not limited to use with this type of display device. For example, the antistatic coating of the present invention may be used equally as well on the outer surface of field emission displays (FEDs), plasma discharge panel (PDPs), vacuum florescent screens, and gas discharge screens. The phosphor layer 42 on the inner surface of the glass display screen 40 may be in the form of a large number of discrete dots or stripes. A conductor 52 may be attached to the outer surface portion of the display screen 40 for connecting the display screen to neutral ground potential.

Figure 3:
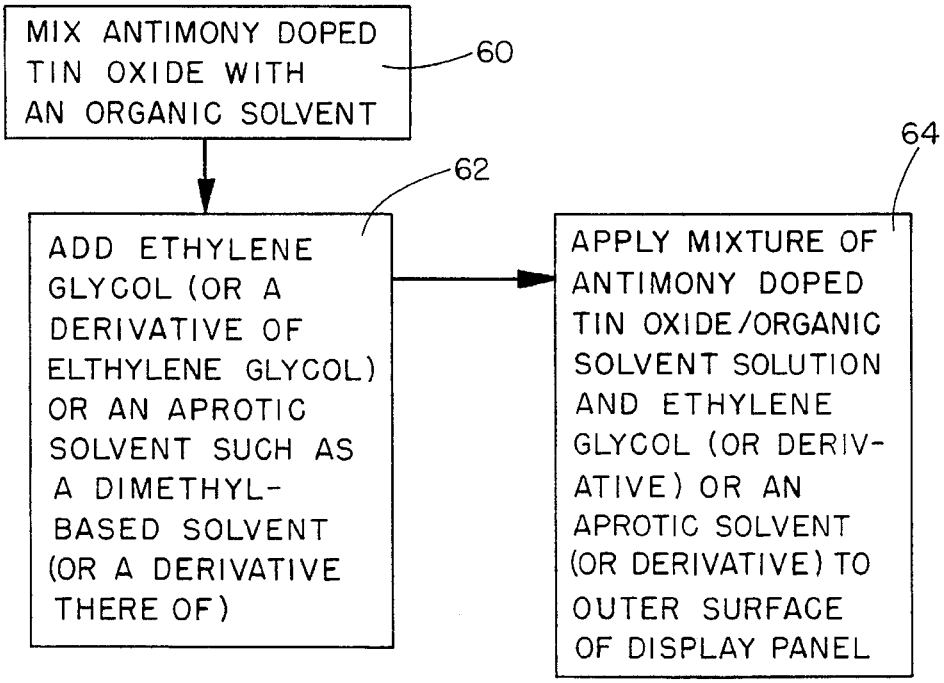
FIG. 3 is a flow chart illustrating the steps involved in preparing and applying an antistatic coating to the outer surface of a glass display screen in accordance with the present invention.

In accordance with the present invention, and as shown in the process flow diagram of FIG. 3, the antistatic coating 44 is formed by mixing a solution of antimony doped tin oxide with an organic solvent such as ethanol, isopropanol, etc. This is performed at step 60 in the method of the present invention. Next, a selected solvent is then added to the antimony doped tin oxide containing the organic solvent in the range of 5–20 wt. %. The selected solvent is either ethylene glycol, or its derivatives, dimethyl solvent, or its derivatives. The derivatives of ethylene glycol which may he added to the antimony doped tin oxide containing the organic solvent include ethylene glycol diacetate, ethylene glycol dibutyl ether, ethylene glycol monoalkyl ether, ethylene glycol monoalkyl ethyl ether acetate, etc. The derivatives of a dimethyl-based solvent which may he added to the antimony doped tin oxide with an organic solvent at step 62 include dimethyl formamide, dimethyl sulfoxide, dimethyl acetamide, etc. The mixture of the antimony doped tin oxide/organic solvent solution and either the ethylene glycol or dimethyl-based solvent, or derivatives thereof, is then applied to the outer surface of the display screen by conventional means such as dipping or spraying as shown at step 64.

The general characteristics of the solvent added to the antimony doped tin oxide containing the organic solvent, whether it is ethylene glycol or a dimethyl-based solvent is that the solvent should he soluble in both water and alcohol. Furthermore, the solvent should have an evaporation point higher than that of water and should possess a better solubility to oil contaminants than to water.

A glass faceplate having an antistatic coating in accordance with the present invention on its outer surface is less susceptible to water marks such as when cleaned, particularly during the manufacturing process. In addition, an antistatic coating in accordance with the present invention is more easily applied uniformily on the outer surface of the display green then prior art antistatic coatings. Finally, the manufacturing yield of display screens coated with an antistatic layer in accordance with the present invention is substantially increased over prior art approaches. For example, manufacturing runs employing an antistatic coating of a solution containing 1 wt. % of antimony doped tin oxide, 10 wt. % water and balanced with a mixture of alcohol, provided a manufacturing yield of 60–90% depending upon the cleanliness of the faceplate and the presence of water marks. The manufacturing yield for glass faceplates with the same antistatic solution to which 10 wt. % ethylene glycol was added provided a yield of approximately 95%, with water marks completely eliminated from the glass faceplate.

With the addition of the disclosed ethylene glycol or dimethyl-based solvent, or derivatives thereof, the hardness and abrasion resistance of the display screen coating is also substantially increased. For example, a prior art display screen coating was measured to be resistant to lead pencils up to a hardness of 7H, while an antistatic coating in accordance with the present invention was determined to be resistant to lead pencils having a hardness of 9H. In addition, where ▲G is the change in gloss value before and after an abrasion test, prior art antistatic coatings exhibit a change (reduction) in gloss value of 7–8. An antistatic coating containing ethylene glycol or a dimethyl-based solvent, or derivatives thereof, in accordance with the present invention exhibits a change (reduction) in gloss value of 3–4. The change in gloss value was determined by rubbing a designated area of the antistatic coating on a video display screen with a pencil eraser twenty (20) rounds (or cycles) under a pressure of one (1) Kg.

There is thus been shown an improved antistatic coating for a video display screen which renders the display screen much less susceptible to surface contamination and wiping residues which remain after the cleaning process. The antistatic coating includes conventional antimony doped tin oxide which is mixed with an organic solvent to which is added either ethylene glycol or a dimethyl-based solvent, or derivatives thereof. Applying the inventive antistatic coating to the outer surface of the video display panel substantially increases the manufacturing yield of display screens and completely eliminates water marks from the panel after they are cleaned.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration on and not as a limitation. The actual scope of the invention is intended to be defined in the following claims when viewed in their proper perspective based on the prior art.

We claim:

1. A video apparatus comprising:

a display panel having an outer and an inner surface; and an antistatic coating layer disposed on the outer surface of said display panel, said coating layer comprised of a conductive metal oxide, an organic solvent and a non-alcohol solvent having a dimethyl amide group or dimethyl sulfide group, or a derivative thereof, wherein said antistatic coating layer is comprised of 5–20 wt. % of said non-alcohol solvent, or derivative thereof, and wherein said non-alcohol solvent, or derivative thereof, is (1) soluble in water and alcohol, (2) has an evaporation point higher than that of water, and (3) has greater solubility for oil-based contaminants than for water.

2. The video display apparatus of claim 1 wherein said antistatic layer further comprises 10 wt. % water and 1 wt. % of said conductive metal oxide.

3. The video display apparatus of claim 1 wherein said derivative of said non-alcohol solvent is selected from the group consisting of dimethyl formamide, dimethyl sulfoxide, and dimethyl acetamide.

4. The video display apparatus of claim 1 wherein said organic solvent is an alcohol or alcohol mixture.

5. The video display apparatus of claim 4 wherein said organic solvent is ethanol or isopropanol, or a mixture of ethanol and isopropanol.

6. The video display apparatus of claim 1 wherein said display panel is a field emission display, a plasma discharge panel, a vacuum florescent screen, or a gas discharge screen.

7. The video display apparatus of claim 1 wherein said conductive metal oxide is antimony doped tin oxide.

* * * * *

UNITED STATES PATENT AND TRADEMARK OFFICE

CERTIFICATE OF CORRECTION

PATENT NO. : 5,580,662

DATED : 12/3/96

INVENTOR(S) : Hua-Sou Tong, Chung-Min Hu and Yu-Chung Yu

It is certified that error appears in the above-indentified patent and that said Letters Patent is hereby corrected as shown below:

| COLUMN | LINE | |
|---|---|---|
| 3 | 38 | After "or its derivatives," it should read -- or a dimethyl solvent, --。 |
| 3 | 66 | "green" should be -- screen --. |
| 4 | 57 | After "video" add -- display --. |

Signed and Sealed this

Eleventh Day of February, 1997

Bruce Lehman

*Attest:*

BRUCE LEHMAN

*Attesting Officer*

*Commissioner of Patents and Trademarks*